US007255204B2

(12) United States Patent
Elmiger et al.

(10) Patent No.: US 7,255,204 B2
(45) Date of Patent: Aug. 14, 2007

(54) APPARATUS FOR MOVING ELEVATOR EQUIPMENT

(75) Inventors: Pius Elmiger, Ermensee (CH); Carlos Latorre Marcuz, Shanghai (CN)

(73) Assignee: Inventio AG, Hergiswill (CH)

( * ) Notice: Subject to any disclaimer, the term of this patent is extended or adjusted under 35 U.S.C. 154(b) by 54 days.

(21) Appl. No.: 11/174,803

(22) Filed: Jul. 5, 2005

(65) Prior Publication Data

US 2006/0042880 A1 Mar. 2, 2006

(30) Foreign Application Priority Data

Jul. 7, 2004 (EP) ..... 04405428

(51) Int. Cl.
*B66B 7/00* (2006.01)

(52) U.S. Cl. ..... 187/414; 294/67.5; 294/164; 294/167; 254/126; 254/134; 254/1; 248/589; 248/323

(58) Field of Classification Search ..... 187/356, 187/359, 362, 363, 367, 370, 372, 379, 409; 104/127, 128; 248/323, 589; 254/1, 126, 254/134; 294/67.5, 164, 167; *B66B 5/16, B66B 5/12, 7/00*

See application file for complete search history.

(56) References Cited

U.S. PATENT DOCUMENTS 803,245 A * 10/1905 Mater ..... 337/187
1,696,557 A * 12/1928 Tomlin ..... 187/367
2,747,690 A * 5/1956 Vandergriff ..... 187/367
2,804,175 A * 8/1957 Phillips ..... 187/368
4,333,549 A * 6/1982 Davis ..... 187/377
5,224,570 A * 7/1993 Fromberg ..... 187/376
6,082,506 A * 7/2000 Huang et al. ..... 188/189

FOREIGN PATENT DOCUMENTS

EP 0 983 956 A2 3/2000
JP 05229766 9/1993

* cited by examiner

*Primary Examiner*—Gene O. Crawford
*Assistant Examiner*—Stefan Kruer
(74) *Attorney, Agent, or Firm*—Schweitzer Cornman Gross & Bondell LLP

(57) ABSTRACT

An apparatus for moving elevator equipment, particularly an elevator car when stuck in a shaft, comprises a suspension point which is connected to the elevator equipment by an adjustable-height connection. Contrary to the prior art, the suspension point includes a length-adjustable assembly configured for engagement with opposing walls of the shaft or opposing guide rails within the shaft at any chosen location along the shaft. The invention thus provides a localized solution that can be used conveniently at any position within the shaft and is therefore independent of the position, and indeed the presence, of any lifting hooks within the shaft.

10 Claims, 3 Drawing Sheets

APPARATUS FOR MOVING ELEVATOR EQUIPMENT

The present invention relates to an apparatus for moving elevator equipment disposed within an elevator shaft and is particularly adapted for the release of a car stuck in the shaft.

BACKGROUND OF THE INVENTION

Occasionally, an elevator car can become stuck within a shaft and it is necessary to release the car before the elevator can be returned to normal operation. Such a situation can occur if safety gear mounted on the car has been released to frictionally engage with the guide rails so as to bring the car to an abrupt emergency stop. The energy dissipated through this frictional engagement can in some instances cause the safety gear (and thereby the car) to stick to the guide rails. The common practice to effect the release of the car is to suspend it from a lifting hook located at a position above the car within the hoistway by a rope or cable and to then hoist the rope or cable so as to raise and thereby release the car. This procedure becomes cumbersome and time consuming if the nearest lifting hook is not within easy reach of the car roof.

BRIEF DESCRIPTION OF THE INVENTION

The objective of the present invention is to overcome this problem by providing an apparatus for moving elevator equipment disposed within a shaft. The apparatus comprises a suspension point and height-adjustable means configured for interconnecting the suspension point within the shaft and the elevator equipment. Contrary to the prior art, the suspension point comprises a length adjustable means configured for engagement with opposing walls of the shaft or opposing guide rails within the shaft. Hence, the invention defines a localized solution that can be used conveniently at any position within the shaft and is therefore independent of the position, and indeed the presence, of any lifting hooks within the shaft.

Preferably, the length adjustable means includes shoes for frictional engagement with the opposing walls of the shaft or opposing guide rails. Accordingly, the user does not have to make any special surface preparation before installing the apparatus. In a preferred embodiment, each shoe has a U-shaped housing defining a tapered channel to receive a blade of the guide rail, the channel being wider at its bottom than at its top, and further comprises a roller for insertion into the channel. This is a quick and effective way of securing the length adjustable means to the opposing guide rails.

In one embodiment, the length adjustment means includes a bar having opposing ends for insertion into sleeves provided on the opposing shoes. Each of the sleeves may be spring biased away from the bar towards the opposing guide rail or wall. Alternatively, a series of adjustment holes can be provided in the bars and a pin can be passed through the sleeve and one of the adjustment holes to fasten the bar to the sleeve.

In an alternative embodiment, the length adjustment means may include two interconnectable bars. The bars can be interconnected at a central hub. Preferably, the bars are accommodated in through holes in the hub. As before, each bar can have a series of adjustment holes and can be fastened to the hub by a pin passing through the hub and one of the adjustment holes. Advantageously, the through holes intersect within the hub. Hence each of the bars extends outwards and downwards from the hub to engage with the guide rail or shaft wall. The inclined angle each bar makes with the corresponding guide rail or wall helps enhance the friction therebetween especially when force is exerted on the apparatus. The force exerted through the interconnected bar arrangement has a horizontal as well as a vertical component at the opposing shaft walls or guide rails; the vertical component to overcome the weight and sticking force of the trapped elevator equipment; the horizontal component of the force ensures the shoes are held firmly in place against the opposing shaft walls or guide rails.

The length adjustable means can include a threaded hole, in which case the height adjustable means can be a threaded bolt for rotatable engagement with the threaded hole of the length adjustable means. Alternatively, a conventional lift device such as a chain block or a rope hoist can be used.

BRIEF DESCRIPTION OF THE DRAWINGS

The invention is herein described by way of specific examples with reference to the accompanying drawings in which.

DETAILED DESCRIPTION OF THE INVENTION

Figure 1:
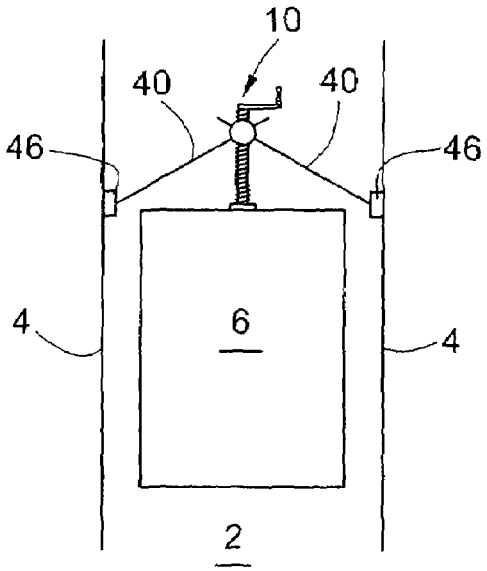
FIG. 1 is a general diagrammatic overview of a lifting apparatus according to a first embodiment of the present invention.
Figure 2:
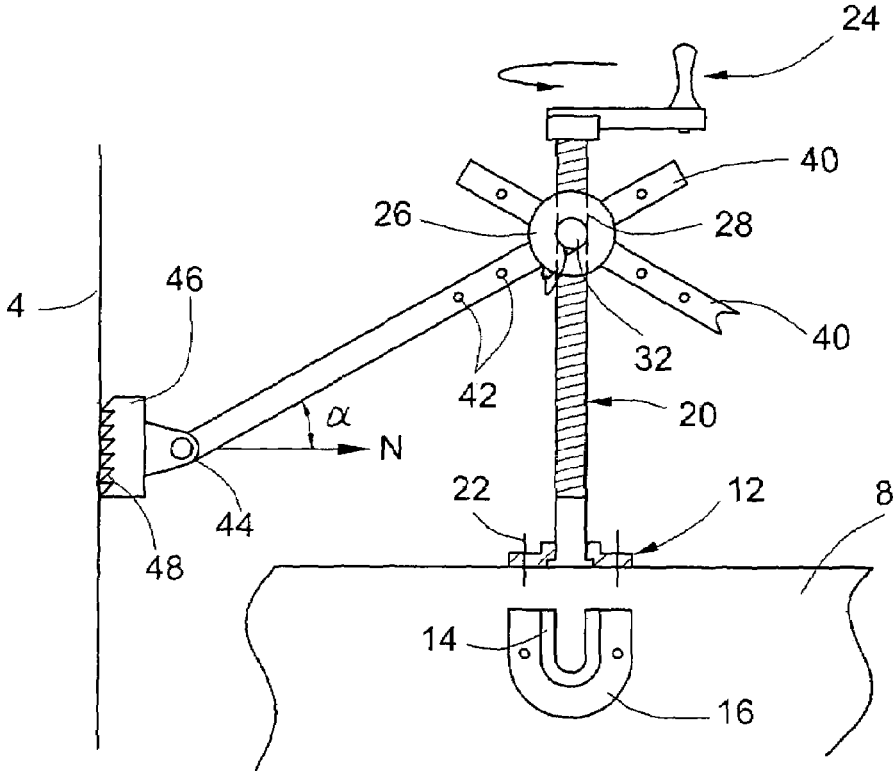
FIG. 2 is a partial plan view of the apparatus of FIG. 1.

FIG. 1 illustrates a car 6 which is stuck within a shaft 2 of an elevator installation. A lifting apparatus 10 according to a first embodiment of the invention is erected on top of the car 6 to lift and thereby free the car 6. As shown in FIG. 2, the lifting apparatus 10 comprises a square thread bolt 20 having a flange 22 located at its lower end. The flange 22 is inserted into and retained in a space defined between an inner, upper collar 14 and an outer, lower collar 16 of a U-shaped retainer 12 mounted on the roof 8 of the car 6. The bolt 20 and the flange 22 are freely rotatable with respect to the retainer 12. A handle 24 is secured to an upper end of the square thread bolt 20 to enable the user to manually rotate the bolt 20.

Figure 3:
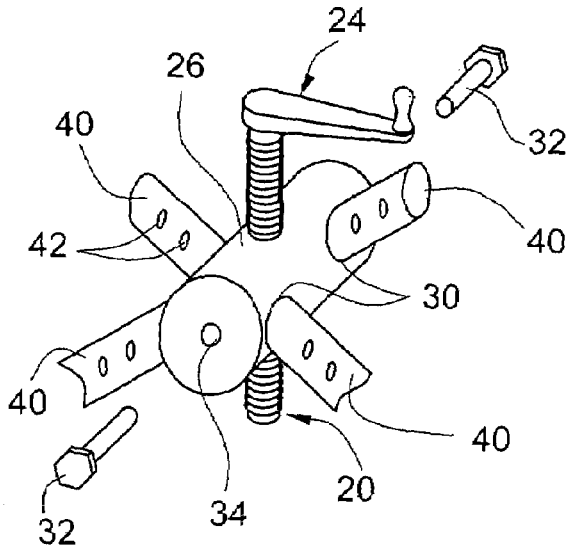
FIG. 3 is a perspective view of the of the hub of the apparatus shown in FIGS. 1 and 2.

The bolt 20 passes through and engages a correspondingly threaded hole 28 provided in a hub 26. Accordingly, relative rotation between the hub 26 and the bolt 20 causes the hub 26 to move along the length of the bolt 20. Two structural tubes 40 are adjustably mounted within holes 30 shown in FIG. 3 provided through the hub 26 and extend outwards and downwards from either side of the hub 26 towards opposing walls 4 of the shaft 2. A shoe 46 is pivotally mounted on an end 44 of each tube 40. Each shoe has a toothed surface 48 to enhance the frictional engagement between the shoe 46 and the shaft wall 4.

Once the bolt 20 has been erected on the car roof 8, the tubes 40 are extended from the hub 26 until the shoes 46 engage with the opposing walls 4 of the shaft 2. In this position, each tube 40 is inclined to the normal N of the respective wall 4 at an angle α. The tubes 40 are then secured to the hub 26 by retention pins 32 inserted through pin holes 34 in the hub 26 and adjustment holes 42 in the tubes 40 (as shown in FIG. 3).

The lifting apparatus 10 is now fully installed and in operation the user turns the handle 24 in an anticlockwise direction causing the bolt 20 to move upwards within the hub 26. After the inherent initial slack in the system has been taken up, the lifting apparatus 10 builds up sufficient lifting force to firstly overcome the weight of the car and then, with further rotation of the handle 24, the lifting force is sufficient to overcome the force retaining the car 4 in its stuck position. The stuck car 4 is thereby released.

Figure 4:
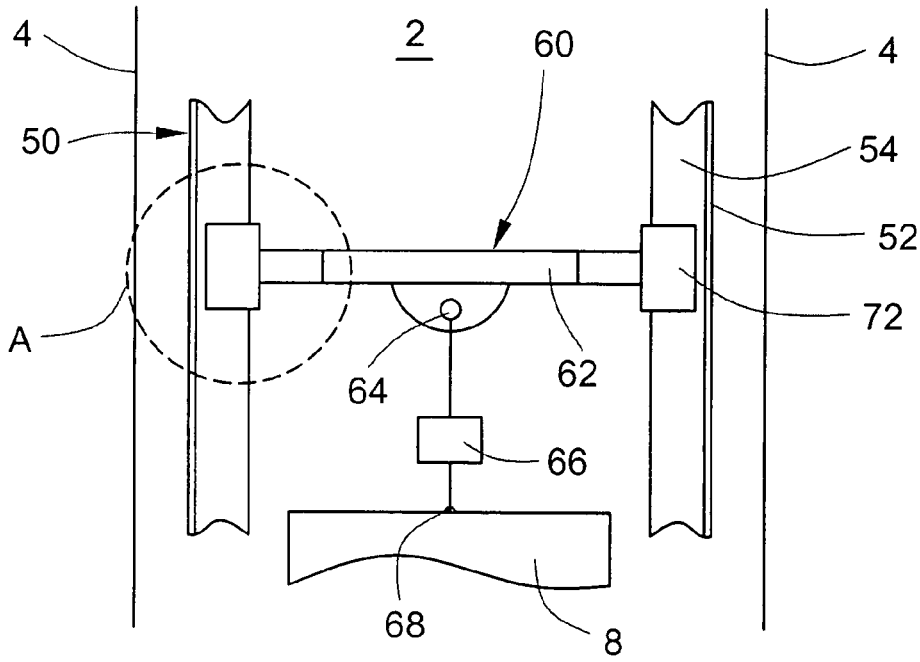
FIG. 4 is a plan view of a lifting apparatus according to a second embodiment of the present invention.

FIG. 4 shows a second embodiment of the present invention wherein a lifting apparatus 60 is secured between T-profile guide rails 50 mounted on the shaft walls 4 to release a car stuck within the shaft 2. Each guide rail 50 has laterally extending side flanges 52 and a transverse guide blade 54. The side flanges 52 are affixed to the corresponding side wall 4 through brackets (not shown). The transverse guide blades 54 extend into the shaft 2 to provide a guiding surface for the guide shoes or roller guides (not shown) provided on the car 6.

The lifting apparatus 60 comprises an intermediate bar 62 with telescopic end shoes 72 to engage with the opposing guide blades 54. A conventional lifting device 66 such as a chain block or rope hoist is installed between a lifting eye 64 on the intermediate bar 62 and fastening means 68 on the car 6.

Figure 5:
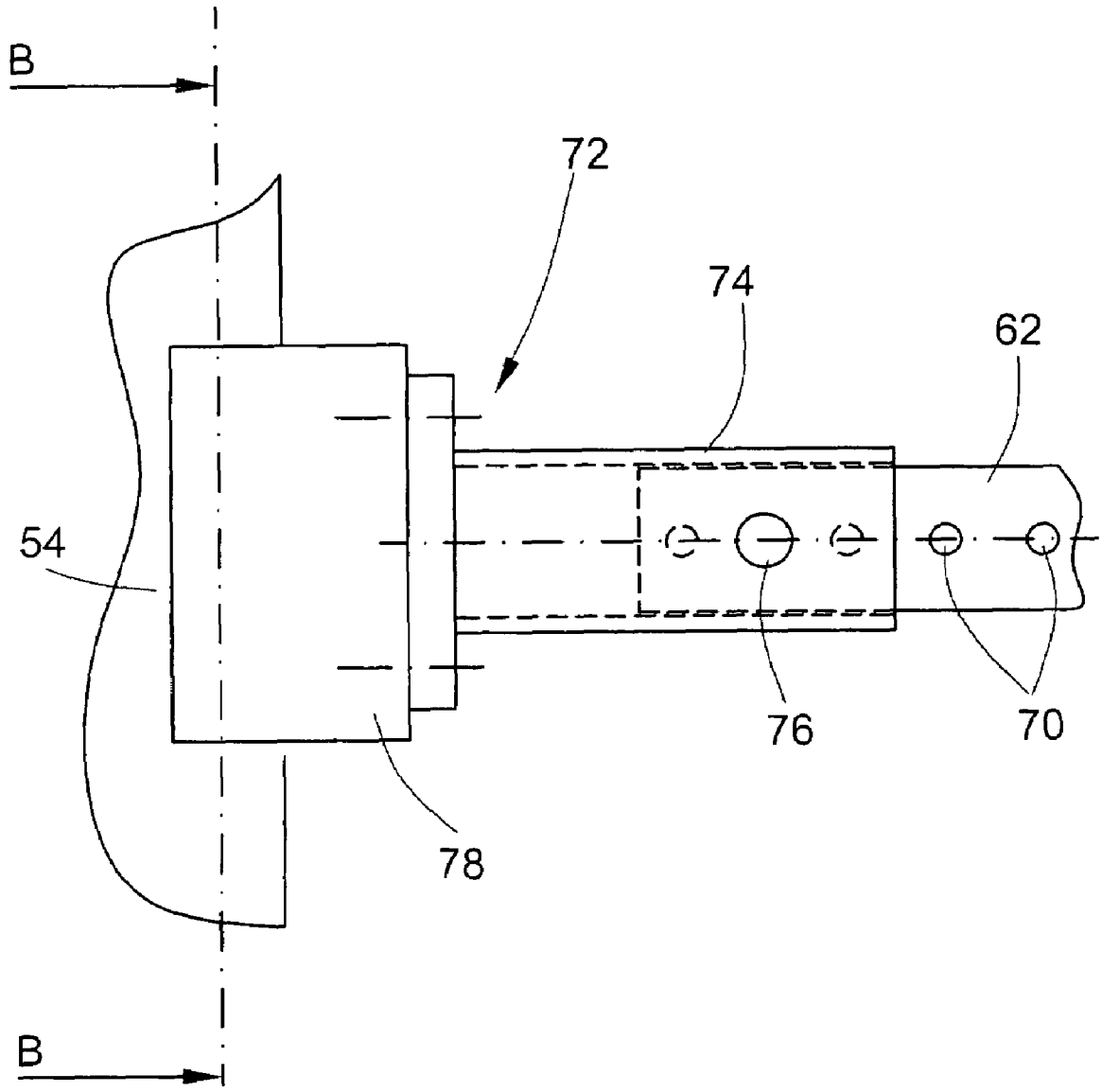
FIG. 5 is a partial, exploded view of region A in FIG. 4, depicting an end shoe of the lifting apparatus.

As shown in FIG. 5, an exploded view of section A in FIG. 4, the intermediate bar 62 is received in a sleeve 74 provided in each end shoe 72. The end shoes 72 are extended outwards from the intermediate bar 62 until they partially envelope the blade 54 of the respective guide rail 50 and adjustment pins 76 are then inserted through the sleeves 74 and adjustment holes 70 in the intermediate bar 62 to lock the arrangement between the opposing guide rails 50.

Figure 6:
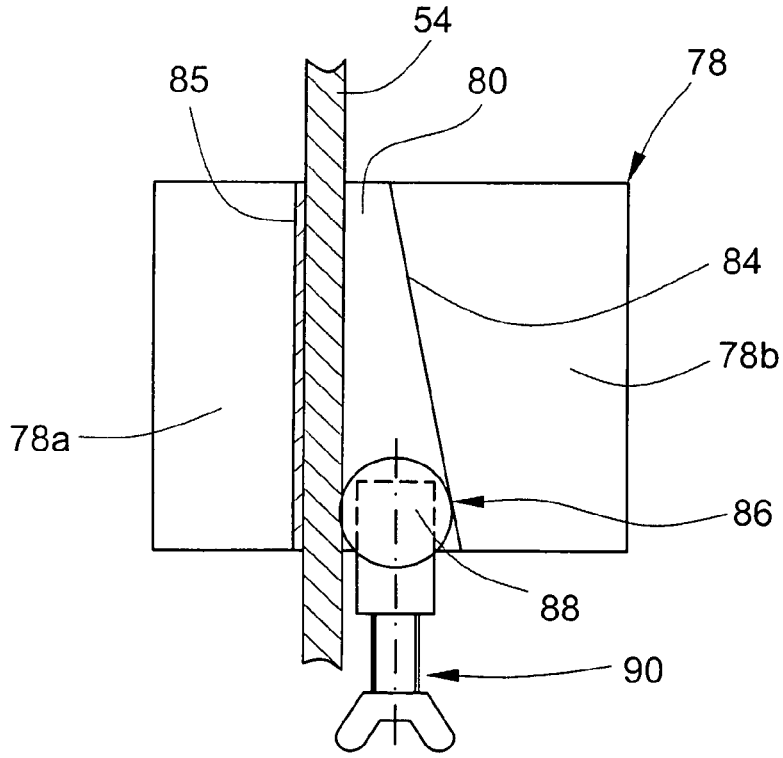
FIG. 6 is a lateral cross-section through the end shoe along line B-B of FIG. 5, further depicting a locking mechanism for the end shoe.

FIG. 6 is a cross-section through line B-B of FIG. 5 and shows how each end shoe 72 envelopes and subsequently engages with its corresponding guide rail 50. The housing 78 is generally U-shaped, having a first end limb portion 78*a* and a second tapered limb portion 76*b* defining a channel 80 therebetween. The guide rail blade 54 is accommodated within this channel 80, which is broader at the bottom than at the top. To secure the locked arrangement of intermediate bar 62 and end shoes 72 to the guide rails 50, a captive roller 86 is inserted through the bottom of the channel 80 alongside the guide rail blade 54. As the roller 86 is moved upwards along an inclined surface 84 of the second tapered limb portion 76*b* of the housing 76, it comes to a point where the channel 80 is only sufficient in width to accommodate the roller 86 and the guide rail blade 54. At this point the roller 86 and the guide rail blade 54 frictionally engage and become wedged in the channel 80, and any downward motion of the locked arrangement of intermediate bar 62 and end shoes 72 relative to the guide rail 50 is prevented. Preferably, the inner surface 85 of the first limb portion 78 has a high coefficient of friction.

With the lifting apparatus 60 installed as discussed above, the user operates the lifting device 66 to lift and release the trapped car 6. To dismantle the lifting apparatus 60, the user pulls down on a winged nut 90 connected to an axle 88 of the roller 86, thereby unfastening the end shoe 72 from the guide rail 50.

In the embodiments described above it is assumed that the car 6 is of the self-supporting type. However, it will be apparent to those skilled in the art that the invention can equally be employed for cars supported in a frame wherein the lifting apparatus would be attached to the upper yoke of the car frame rather than the car roof.

It will also be understood that the invention can be used to release a stuck counterweight, or indeed any equipment within the elevator shaft 2.

Furthermore, it will be realised that individual components of the two embodiments described in detail above can be combined to give further variants of the invention. For example, the end shoe housings 78 of the second embodiment could be used to secure the interconnected bars 40 of the first embodiment to the guide rails 50. In another example, the intermediate bar 62 of the second embodiment could have a threaded hole to engage with the threaded bar 20 of the first embodiment.

We claim:

1. An apparatus for moving elevator equipment disposed within a shaft, comprising a suspension point within the shaft and height-adjustable means configured for interconnecting the suspension point and the elevator equipment, the suspension point comprising a length-adjustable means configured for engagement with opposing walls of the shaft or opposing guide rails within the shaft, the height-adjustable means being configured to allow the elevator equipment to be moved vertically when the length-adjustable means is in engagement with the opposing walls or guide rails of the shaft.

2. The apparatus according to claim 1, wherein the length-adjustable means includes shoes for frictional engagement with the opposing walls or opposing guide rails.

3. The apparatus according to claim 2, wherein each shoe has a U-shaped housing defining a tapered channel to receive a blade of a guide rail, the channel being wider at its bottom than at its top, the apparatus further comprising a roller for insertion into the channel.

4. The apparatus according to claim 2 or 3, wherein the length-adjustable means includes a bar having opposing ends for insertion into sleeves provided on the shoes.

5. The apparatus according to claim 2 or 3, wherein the length-adjustable means includes two interconnectable bars each having one of the shoes pivotally mounted to one of its ends.

6. The apparatus according to claim 1, 2 or 3, wherein the length-adjustable means further includes a threaded hole and the height-adjustable means comprises a threaded bolt for rotatable engagement with the threaded hole of the length-adjustable means.

7. The apparatus according to claim 1, 2 or 3, wherein the height-adjustable means is a chain block or rope hoist.

8. The apparatus according to claim 4, wherein the bar has a series of adjustment holes at each of the opposing ends, the bar being fastened to each sleeve by a pin passing through the sleeve and one of the adjustment holes.

9. The apparatus according to claim 5 further comprising a hub having through-holes for accommodating the bars, wherein each bar has a series of adjustment holes and is fastened to the hub by a pin passing through the hub and one of the adjustment holes.

10. The apparatus according to claim 9, wherein the through holes intersect in the hub.

* * * * *